US012281571B2

(12) United States Patent
Baker et al.

(10) Patent No.: US 12,281,571 B2
(45) Date of Patent: Apr. 22, 2025

(54) FLOWLINE NIPPLE / AGITATOR TANDEM EXTRACTION SYSTEM

(71) Applicants: Daniel Baker, Pinehurst, TX (US); Seth Johnson, Houston, TX (US)

(72) Inventors: Daniel Baker, Pinehurst, TX (US); Seth Johnson, Houston, TX (US)

( * ) Notice: Subject to any disclaimer, the term of this patent is extended or adjusted under 35 U.S.C. 154(b) by 492 days.

(21) Appl. No.: 17/808,514

(22) Filed: Jun. 23, 2022

(65) Prior Publication Data

US 2022/0412214 A1 Dec. 29, 2022

Related U.S. Application Data

(60) Provisional application No. 63/214,185, filed on Jun. 23, 2021.

(51) Int. Cl.
*E21B 49/08* (2006.01)
*E21B 49/00* (2006.01)

(52) U.S. Cl.
CPC ..... *E21B 49/088* (2013.01); *E21B 49/005* (2013.01); *E21B 49/0875* (2020.05)

(58) Field of Classification Search
CPC .. E21B 49/088; E21B 49/0875; E21B 49/005; E21B 49/086
See application file for complete search history.

(56) References Cited

U.S. PATENT DOCUMENTS 3,055,743 A * 9/1962 Anderson ..... E21B 49/005 366/279
4,887,464 A * 12/1989 Tannenbaum ..... E21B 49/005 73/19.09
4,961,343 A * 10/1990 Boone ..... E21B 49/005 73/152.08
5,007,488 A * 4/1991 Donovan ..... E21B 21/015 175/209
5,447,052 A * 9/1995 Delaune ..... G01N 30/06 73/19.09
2006/0202122 A1* 9/2006 Gunn ..... E21B 21/01 250/339.13
2011/0313670 A1* 12/2011 DeGreeve ..... E21B 49/00 356/51
2013/0263647 A1* 10/2013 Barrett ..... E21B 21/067 73/31.07
2015/0211311 A1* 7/2015 Shanks ..... B01D 19/0052 95/24
2016/0160641 A1* 6/2016 Rowe ..... E21B 49/086 250/288
2021/0131203 A1* 5/2021 Bingham ..... B01D 33/41

* cited by examiner

*Primary Examiner* — Shane Bomar
(74) *Attorney, Agent, or Firm* — Law Office of Jeff Williams PLLC; J. Oliver Williams

(57) ABSTRACT

A gas extraction assembly includes an agitator gas trap and a nipple apparatus. The nipple apparatus is coupled to a flowline containing a mud mixture. The agitator gas trap is also in communication with the mud mixture. An inline detector is in the nipple apparatus and configured to help separate the mud mixture from a gas. A tube passes between the nipple apparatus and the agitator gas trap to transport the gas from the inline detector to a gas detection and logging unit for sample recording.

10 Claims, 2 Drawing Sheets

FLOWLINE NIPPLE / AGITATOR TANDEM EXTRACTION SYSTEM

CROSS REFERENCE TO RELATED APPLICATIONS

This application claims the benefit of an earlier filing date and right of priority to U.S. Provisional Application No. 63/214,185, filed 23 Jun. 2021, the contents of which is incorporated by reference herein in its entirety.

BACKGROUND OF THE INVENTION

1. Field of the Invention

The present application relates to an extraction system for use with drilling rigs, and more specifically to extract a sample of hydrocarbon gas from drilling fluid for analysis.

2. Description of Related Art

During large scale drilling operations, a wellbore is drilled in the ground. During this process large quantities of mud and cuttings of rock are brought to the surface. It is necessary to log the conditions of the mud that is produced so as to track or record gases for the potential of a blowout or other scenario. Mudlogging refers to the cataloging and tracking of the mud samples. Accurate gas data recorded during the drilling operation is necessary to properly evaluate the below ground reservoir of gas and help pinpoint potentially overlooked producing zones underground.

The standard method of gas extraction involves the use of an agitator gas trap 99 that is positioned in the returning "mud" stream. This is typically in the shaker box, or "possum belly" as seen in FIG. 1. It is imperative that this gas trap is situated in the location of maximum flow of the mud. A limitation of this type of device is it requires regular maintenance performed by a person stationed on the drilling rig to raise/lower the trap in order to keep it in optimal position to properly agitate the fluid and release the hydrocarbons for analysis. Although strides have been made, shortcomings remain.

BRIEF SUMMARY OF THE INVENTION

It is an object of the present application to provide an assembly configured to extract a sample of hydrocarbon gas from the drilling fluid ("mud") on a drilling rig to be processed in real time by gas analysis equipment as an interpretive tool during drilling operations. One object is to install a nipple apparatus into an orifice in the flow line of the mud. The nipple apparatus is configured to extract a gas sample from the flow line and subsequently feed the gas sample to an agitator gas trap external to the flowline of mud.

It is a further object of the present application that the nipple apparatus and the gas trap work in combination with one another. Use of both systems together minimizes work from personnel and greatly increases the quality of the gas sample of total and component gasses.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated.

Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
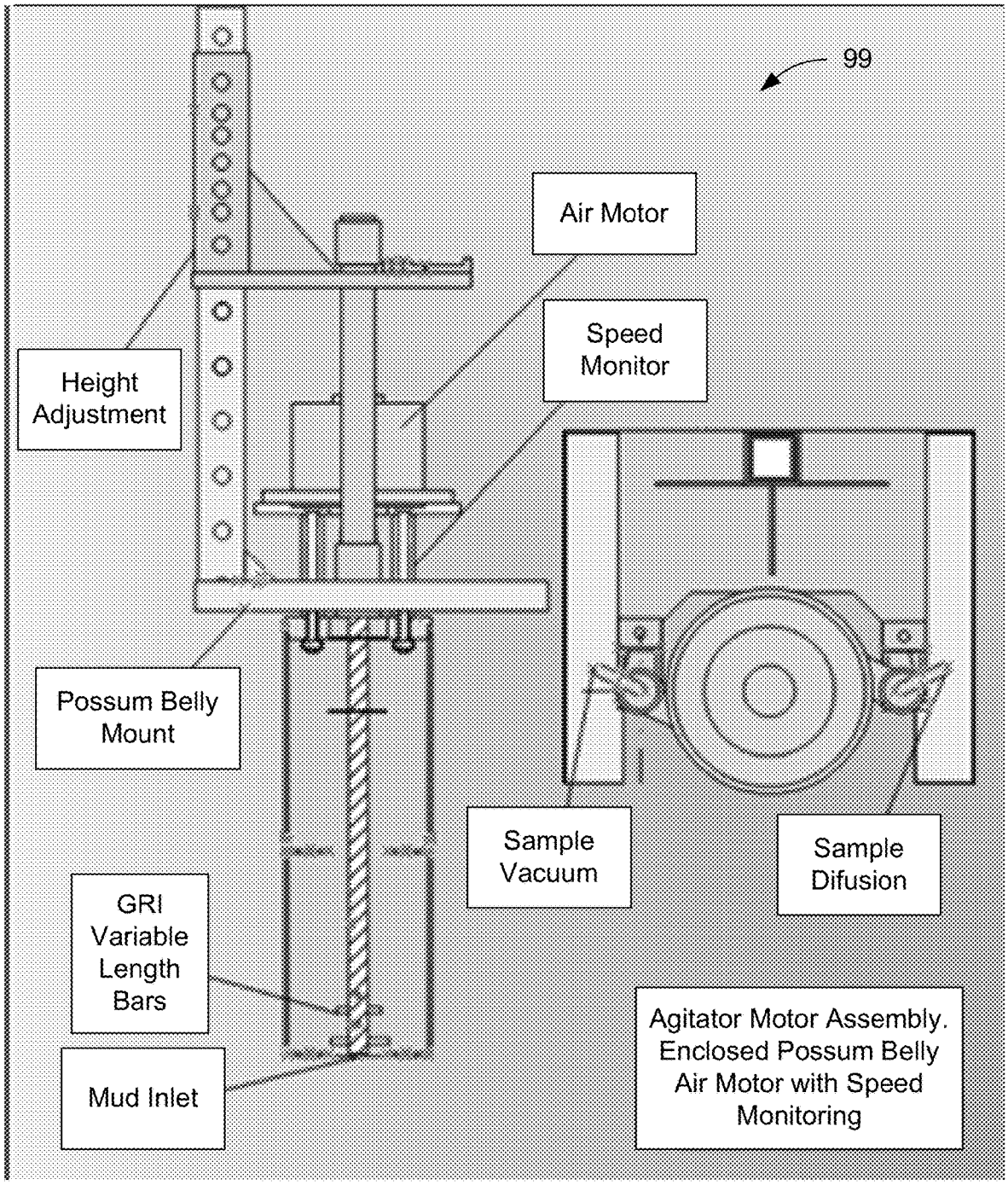
FIG. 1 (Prior Art)
FIG. 1 is a side view of an existing agitator gas trap in a possum belly.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method in accordance with the present application overcomes one or more of the above-discussed problems commonly associated with the prior art discussed previously. In particular, a nipple apparatus works in conjunction with an agitator gas trap. The nipple apparatus is in communication with the mail flow of mud in the flow line and extracts gas from the mud and transfers it to the agitator gas trap for processing and recording. These and other unique features are discussed below and illustrated in the accompanying drawings.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

The system of the present application is configured to extract a sample of hydrocarbon gas from drilling fluid (i.e. "mud" or "mud mixture") on a drilling rig. The gas is then sent to be processed in real time by gas analysis equipment as an interpretive tool during drilling operations. As noted previously, the assembly 101 includes a nipple apparatus 103 and an agitator 105 (i.e. agitator with a gas trap).

Figure 2:
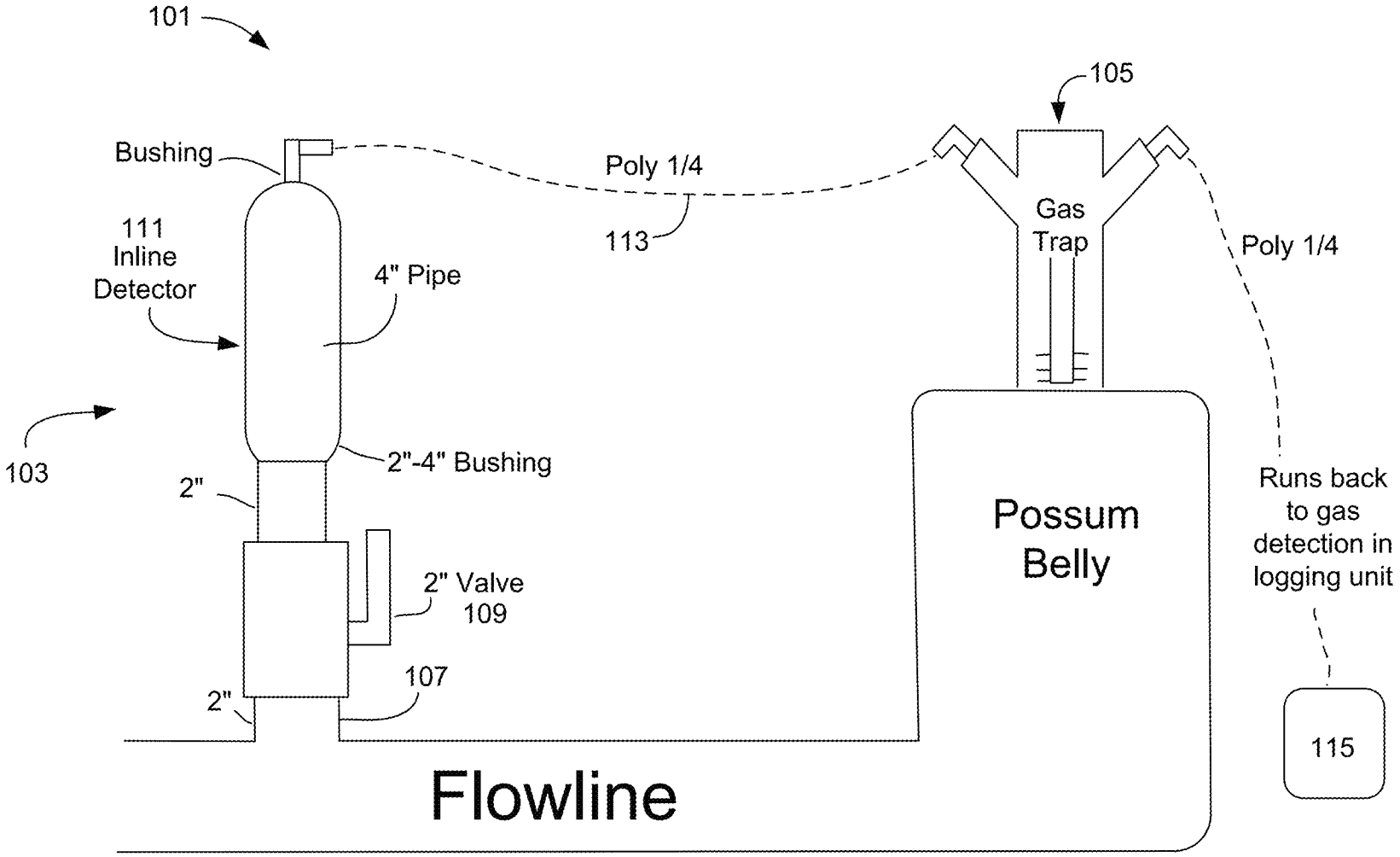
FIG. 2 is a side view of a flowline nipple agitator extraction assembly according to an embodiment of the present application.

Referring now to FIG. 2 in the drawings, a sketch of the Flowline Nipple/Agitator Tandem Extraction System 101 is provided. The nipple apparatus 103 is installed into a "jet line" for the transportation of mud. An orifice 107 is located in the jet line so as to permit flow from the jet line through the orifice and into the nipple apparatus 103. Mud flows upward through a shutoff valve 109 and into an inline detector 111. Valve 109 is configured to selectively open and close to regulate passage of mud through orifice 107. One or more bushings and valves extend therefrom. Inline detector helps in the separation and capturing of gas from the mud.

A gas sample is taken through the nipple apparatus 103 and passed through to agitator 105. A tubing 113 extends from the nipple apparatus 103 towards the agitator 105 gas trap. The tubing can be made from many types of material and be of different sizes. An example would be a ¼" plastic tubing. The gas sample is then agitated along with drilling "mud" and is pulled into the gas detector and logging unit 115 at constant pressure for analysis.

It is understood that one or more extraction systems may be utilized together or distinct from one another to facilitate gas sample analysis. Further development of the system 101 may yield a single apparatus 103 housing both the Nipple Extraction as well as the Agitator Gas Trap.

System 101 includes the use of some existing technologies and components together with the inclusion of novel features to facilitate the accomplishment of gas samples and analysis. Some of the several new features are described herein. System 101 uses a nipple apparatus 103 to extract a gas sample from the flow line. The passing of the gas sample through the tube 113 into the agitator gas trap 105 from the nipple apparatus is also a new feature. This sample is then pulled into the gas detector 115 at a constant pressure from the gas trap 105. A pressure of 6 cubic feet per minute is conceived but other pressures may be possible.

It is understood that nipple apparatus 103 and agitator gas trap 105 may operate simultaneously and/or independently from each other. The sample of gas passed through to unit 115 may be a composite of gas from each of apparatus 103 and trap 105 or an independent sample from either.

The current application has many advantages over the prior art including at least the following: (1) One advantage of adding the Flowline nipple apparatus in tandem with the industry standard agitator gas trap is that the gas detector receives a better sample of total and component gasses resulting in significantly improved data quality for analysis in a remote/unmanned scenario; (2) no personnel are required on the drilling rig in order to maintain the equipment.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A gas extraction assembly, comprising:

a nipple apparatus coupled to a flowline containing a mud mixture;

an agitator gas trap in communication with the mud mixture;

an inline detector in the nipple apparatus configured to help separate the mud mixture from a gas; and a tube passing between the nipple apparatus and the agitator gas trap, the tube configured to transport the gas from the inline detector;

wherein the agitator gas trap passing the gas to a gas detection and logging unit for sample recording.

2. The assembly of claim 1, wherein the nipple apparatus is upstream from the agitator gas trap.

3. The assembly of claim 1, further comprising:

a valve within the nipple apparatus.

4. The assembly of claim 1, wherein gas is extracted from the mud mixture from both the nipple apparatus and the agitator gas trap simultaneously.

5. The assembly of claim 1, wherein suction from the agitator gas trap pulls the gas from the nipple apparatus through the tube.

6. The assembly of claim 1, wherein the nipple apparatus operates independent of the agitator gas trap.

7. A method of extracting a gas sample from drilling fluid from an oil well, comprising:

obtaining a nipple apparatus;

obtaining an agitator gas trap, both the nipple apparatus and the agitator gas trap in communication with the drilling fluid via a flow line;

separating gas from the drilling fluid in the nipple apparatus;

separating gas from the drilling fluid in the agitator gas trap; and transferring the gas from the nipple apparatus to the agitator gas trap for recordation.

8. The assembly of claim 7, wherein gas is extracted from the drilling fluid from both the nipple apparatus and the agitator gas trap simultaneously.

9. The assembly of claim 7, wherein suction from the agitator gas trap pulls the gas from the nipple apparatus through a tube.

10. The assembly of claim 7, wherein the nipple apparatus operates independent of the agitator gas trap.

* * * * *